United States Patent [19]

Melchiori, Jr.

[11] 4,450,662

[45] May 29, 1984

[54] TENSIONED STRUCTURE WITH ADJUSTABLY MOVABLE COLUMNS AND BEAMS

[76] Inventor: Remo Melchiori, Jr., 2350 S. 875 East, Zionsville, Ind. 46077

[21] Appl. No.: 383,521

[22] Filed: Jun. 1, 1982

[51] Int. Cl.[3] ..... F04C 3/10; F04C 3/26

[52] U.S. Cl. ..... 52/223 R; 52/299

[58] Field of Search ..... 52/223 R, 299, 723, 52/227

[56] References Cited

U.S. PATENT DOCUMENTS

| | | | |
|---|---|---|---|
| 1,825,195 | 9/1931 | McAvoy et al. | 52/227 |
| 2,011,312 | 8/1935 | Engman | 52/223 R |
| 2,234,663 | 3/1941 | Anderegg | 52/223 R |
| 2,414,011 | 1/1947 | Billner | 52/223 R |
| 2,496,850 | 2/1950 | Bertrand | 52/223 R |
| 3,380,209 | 4/1968 | Cheskin | 52/223 R |

*Primary Examiner*—John E. Murtagh
*Assistant Examiner*—Michael Safavi
*Attorney, Agent, or Firm*—Woodard, Weikart, Emhardt & Naughton

[57] ABSTRACT

A modular beam/column construction having a tension member securing end caps to the opposite ends of the beams and columns which are placed in compression. In one embodiment, the end caps mounted to horizontally extending beams are in turn secured atop a base plate with a threaded fastener controlling the positioning of the beam ends relative to the base plate. In another embodiment, a cap mounted atop wooden beams is secured to a base plate by a tension member. The cap includes vertically movable adjustment members to horizontally level the cap although the columns are of different lengths.

5 Claims, 12 Drawing Figures

TENSIONED STRUCTURE WITH ADJUSTABLY MOVABLE COLUMNS AND BEAMS

BACKGROUND OF THE INVENTION

This invention is in the field of structures employing tensioned members for placing wooden beams and columns under compression. The construction assembly is designed to be used by owner/builders for on-site assembly of outbuildings. It is known to provide modular construction having prestressed elements such as shown in the U.S. Pat. Nos. 1,825,195, issued to C. F. McAvoy et al., and 3,380,209 issued to D. B. Cheskin. The construction disclosed herein utilizes the previously known tension members while at the same time providing an adjustable beam and column design to be constructed with common stock lumber to create a rigid frame without sawing or nailing required of the frame members. As a result, the construction is simple and quick to assemble by inexperienced builders to exact tolerances while utilizing common lumber stock. The construction also is superior in strength to allow complete confidence in the reliability of the system and it is sufficiently flexible to the design demands of each building or use layout.

SUMMARY OF THE INVENTION

One embodiment of the present invention is a construction assembly comprising a pair of vertical walls, a base plate mounted atop the walls and having a pair of upwardly opening cavities, a pair of vertical wood beams with bottom ends positioned in the cavities and top ends located thereabove, a cap mounted on the top ends and having stop means thereon limiting relative motion between the cap and the beams, a rod like member secured to the cap and the plate placing the member in tension and the beams in compression, and adjustment means on the cap and extending downwardly contacting the top ends to horizontally level the cap although the beams are different lengths.

Another embodiment of the present invention is a construction assembly comprising a base plate having brackets, a first pair of parallel horizontal wood beams mounted to the base plate, a second pair of parallel horizontal wood beams mounted to the base plate, a first pair of boots mounted to opposite ends of the first pair of beams, a first member having opposite ends mounted to the boots placing the member in tension and the first pair of beams in compression, a second pair of boots mounted to opposite ends of the second pair of beams, a second member having opposite ends mounted to the second pair of boots placing the second member in tension and the second pair of beams in compression, first adjustment means connecting one of the first pair of boots with one of the brackets and being operable to horizontally position the first pair of beams relative to the base plate, and second adjustment means connecting one of the second pair of boots with another of the brackets and being operable to horizontally position the second pair of beams relative to the base plate.

It is an object of the present invention to provide a vertical construction assembly having vertical columns assembled together without sawing or nailing required while means are provided to take into account the variable length of the beams.

Another object of the present invention is to provide a horizontal construction having pairs of parallel beams with ends adjustably positioned to create a rigid frame without sawing or nailing required.

Related objects and advantages of the present invention will be apparent from the following description.

DESCRIPTION OF THE PREFERRED EMBODIMENTS

Figure 1:
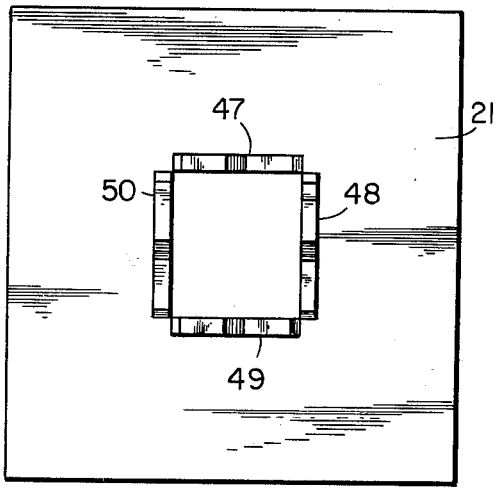
FIG. 1 is a plan view of the base plate of the preferred embodiment of the construction shown in FIG. 6.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 5:
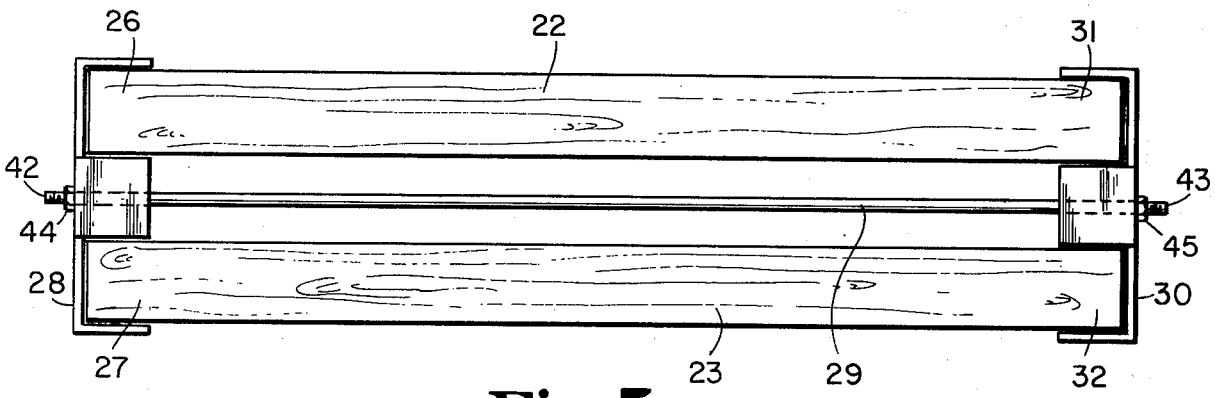
FIG. 5 is a plan view of an assembled boot and beam combination.
Figure 6:
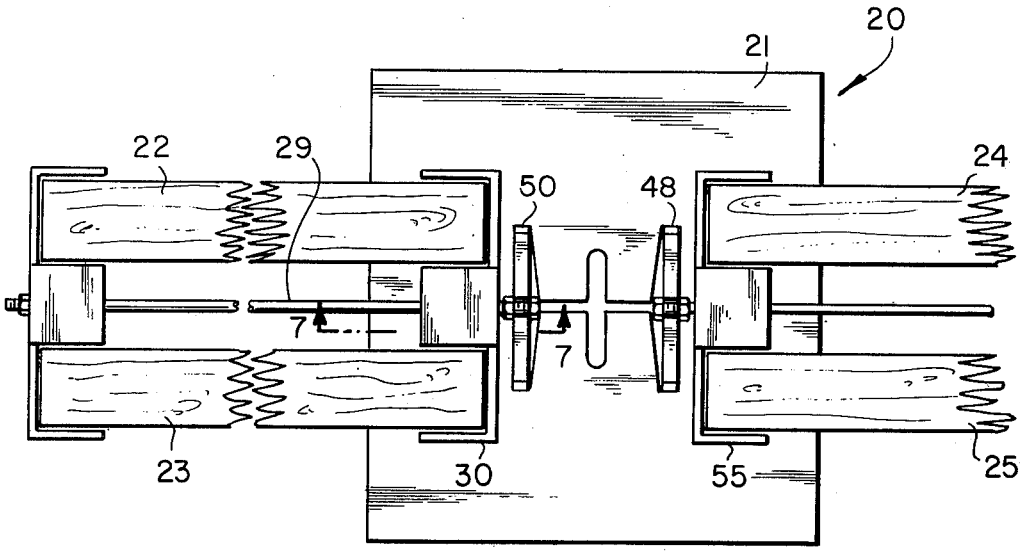
FIG. 6 is a fragmentary plan view of the preferred embodiment of the horizontal construction incorporating the present invention.

Referring now more particularly to FIG. 6, there is shown a horizontal construction 20 having a base plate 21 with a first pair of parallel horizontal wooden beams 22 and 23 along with a second pair of parallel horizontal wooden beams 24 and 25 mounted thereatop. The first pair of wooden beams 22–23 will now be described it being understood that a similar description applies to the second pair of wooden beams 24 and 25. Beams 22 and 23 (FIG. 5) have adjacent ends 26 and 27 mountingly received in a boot 28 secured by tension member 29 to a second boot 30 mountingly receiving the opposite ends 31 and 32 of beams 22 and 23. Boots 28 and 30 along with cable 29 are produced from metal whereas beams 22 and 23 are wooden.

Figure 3:
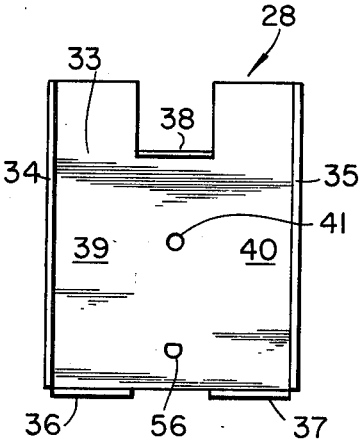
FIG. 3 is a plan view of one of the boots used in the construction of FIG. 6.
Figure 4:
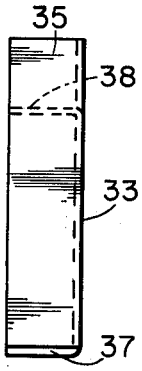
FIG. 4 is a side view of the boot of FIG. 3.

Boot 28 (FIG. 3) is identical to boot 30 and has a flat metal wall 33 with the opposite edge portions 34 and 35 perpendicularly arranged therewith and extending in the same direction therefrom. Walls 34 and 35 extend the length of wall 33. A pair of ears 36 and 37 extend perpendicularly away from wall 33 in the same direction as walls 34 and 35 being positioned at the opposite bottom corners of wall 33 and spaced apart on opposite sides of a third ear 38 likewise extending perpendicularly away from wall 33. The combined lengths of ears 36 through 38 equals the width of wall 33 thereby providing two separate regions 39 and 40 to receive the opposite spaced apart ends of beams 22 and 23. A hole 41 is provided in wall 33 intermediate portions 39 and 40 to receive the threaded end 42 (FIG. 5) of cable 29 with the opposite end 43 of the cable extending through an aperture in boot 30 similar to aperture 41. Thus, by placing the opposite end portions of the wooden beams within portions 39 and 40 of the two boots, and by positioning the cable between the beams to extend through the boots, the beams 22 and 23 may be placed in compression by placing cable 29 under tension. A pair of hexagonal shaped conventional fasteners 44 and 45 are threaded onto ends 42 and 43 adjacent boots 28 and 30 to place the rod-like member or cable 29 under tension.

Figure 2:
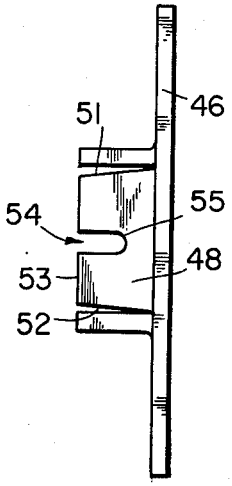
FIG. 2 is a side view of the plate of FIG. 1.
Figure 7:
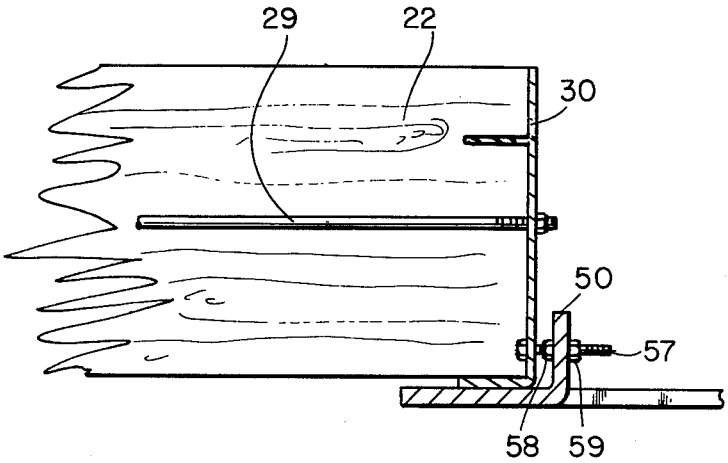
FIG. 7 is an enlarged fragmentary cross-sectional view taken along the lines 7—7 of FIG. 6 and viewed in the direction of the arrows.

Base plate 21 includes a flat wall 46 having four brackets 47, 48, 49 and 50 extending perpendicularly therefrom at the center portion of the wall and arranged at 90° intervals therearound. Each bracket is identical and thus the description of bracket 48 will apply equally to brackets 47, 49 and 50. Bracket 48 (FIG. 2) includes a pair of opposite converging edges 51 and 52 terminating at the distal end 53 of the bracket. A slot 54 having a rounded bottom 55 is provided in distal end 53 and is positioned equidistant between edges 51 and 52. Brackets 47 through 50 are normally co-planar with wall 46 but are bendable upward to the position shown in FIG. 2 to be adjacent the boot associated therewith. For example, in the construction shown in FIG. 6 brackets 48 and 50 extend upwardly adjacent boots 55 and 30 whereas brackets 47 and 49 lie in the same plane as wall 46. The slot 54 provided in each bracket receives a threaded fastener fixedly mounted to the associated boot thereby connecting the bracket and adjacent boot together. A D-shaped hole 56 (FIG. 3) receives a conventional bolt 57 (FIG. 7) having a D-shaped cross section with the head of the bolt located inwardly of boot 30 in turn connected to tension cable 29. Bolt 37 extends through bracket 50 and is in meshing engagement with a pair of conventional nuts 58 and 59 positioned on the opposite sides of bracket 50 to prevent relative motion between bracket 50 and bolt 57. By rotating nuts 58 and 59, the spacing between bracket 50 and boot 30 or the end of beam 22 may be controlled. Thus, bolt 57 provides an adjustment means to connect the boot with the bracket and is operable to horizontally position the associated beams 22 and 23 relative to base plate 21. A similar bolt is provided on boot 55 and bracket 48 providing a second adjustment means to also position the second pair of beams 24 and 25 relative to the base plate.

Figure 8:
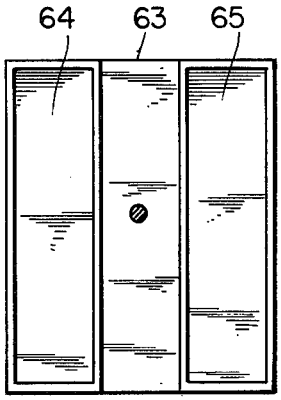
FIG. 8 is a plan view of the base plate of an alternate embodiment of a vertical construction shown in FIG. 12.
Figure 9:
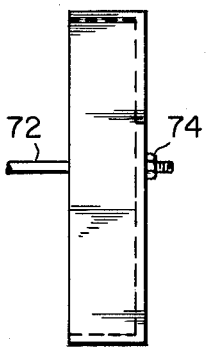
FIG. 9 is a side view of the plate shown in FIG. 8.
Figure 10:
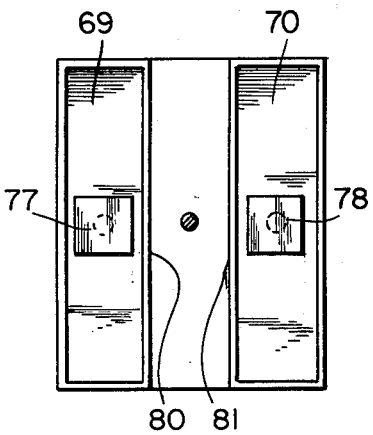
FIG. 10 is a plan view of the column cap utilized in the construction shown in FIG. 12.
Figure 11:
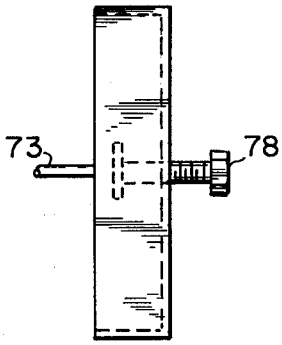
FIG. 11 is a side view of the cap of FIG. 10.
Figure 12:
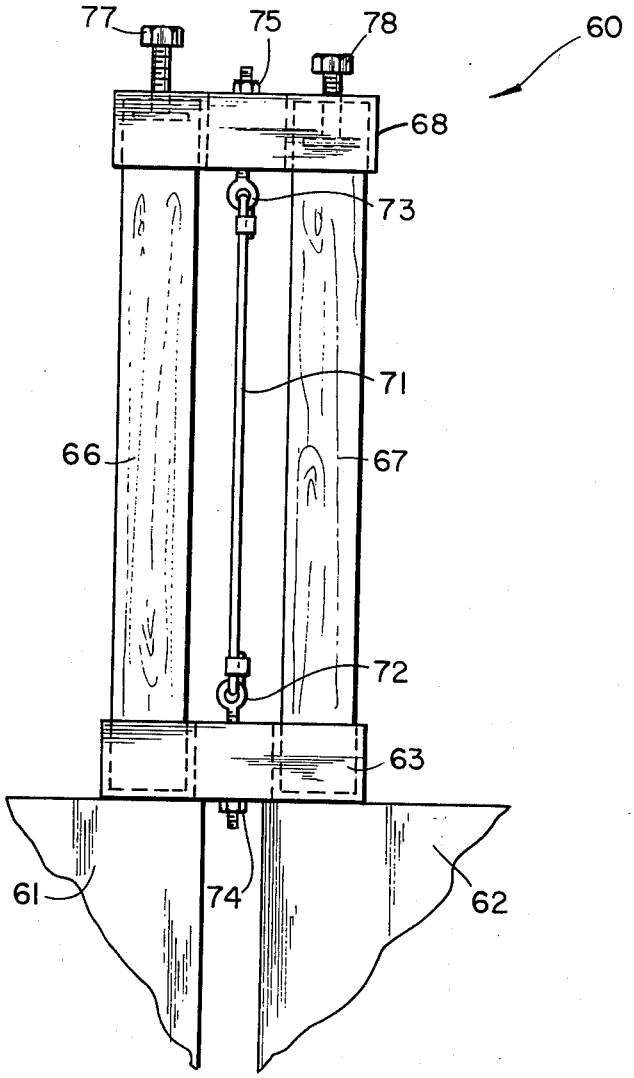
FIG. 12 is a fragmentary side view of an alternate embodiment of the present invention showing a vertical construction.

The alternate embodiment of the construction is shown in FIG. 12 with the vertical construction 60 including a pair of vertically extending walls or beams 61 and 62 upon which is mounted a base plate 63. Plate 63 (FIG. 8) has a pair of upwardly opening cavities 64 and 65 mountingly receiving the bottom ends of a pair of vertical wood beams 66 and 67 (FIG. 12). A cap 68 is mounted on the top end of beams 66 and 67 and has a pair of downwardly opening cavities 69 and 70 (FIG. 10) providing means to receive the top ends of the beams. A rod like member or cable 71 has opposite ends secured to eyebolts 72 and 73 in turn mounted to plate 63 and cap 68. The opposite ends of cable 71 are looped through eyebolts 72 and 73 and secured to the main body of the cable by a clamp or other conventional fastening means. Bolts 72 and 73 extend respectively through plate 63 and cap 68 and are in meshing engagement with conventional nuts 74 and 75 which may be rotated to increase or decrease the spacing between eyebolts 72 and 73 to control the tension in cable 71. As plate 63 and cap 68 are pulled together by the tension cable 71, columns 66 and 67 are placed in compression.

A pair of threaded fasteners 77 and 78 having enlarged bottom ends to contact respectively the top ends of beams 66 and 67 are threadedly mounted to cap 68 and extend respectively into cavities 69 and 70. Bolts 77 and 78 provide an adjustment means on cap 68 which extends donwardly to contact the top ends of columns 66 and 67 even though the columns are of unequal length while at the same time horizontally leveling cap 68. Cavities 69 and 70 (FIG. 10) are surrounded respectively by walls 80 and 81 providing a stop means to limit relative motion between the top ends of the columns and cap 68.

The construction disclosed herein is designed to be constructed with common stock lumber to create a rigid frame without sawing or nailing frame members. The adjustable beam or column is made by placing metal abutments or boots on either end of two or more lumber pieces and securing them by a cable tightened from boot to boot. The adjustment of length is accomplished by the mechanical displacement of the boot within the beam or column union. Length deviations of up to + or $-\frac{3}{8}''$ in the common stock lumber are easily accommodated by the system.

The beam or column union is designed so that bearing forces are wood on metal on wood. In the free standing condition, there is no stress placed on the boots or unions other than the cable tension securing the beam or column ends. The primary function of the boot union assembly is to position supporting members exactly. As load is placed on the frame, the forces on the members are compressive. Bending forces on beams are held by the normal beam characteristics of the lumber enhanced by the tensile strength of the cable. Lateral forces are held by the normal wall construction as in any structure or by the cross cabling in the free standing state. The columns have an internal cavity from bottom to top whereby a cable secured in the foundation can be tightened to the uppermost union. Additional members are designed to ease door, window and roof assembly. Further, it can be appreciated that the vertical construction shown in FIG. 12 can be used in combination with the horizontal construction shown in FIG. 6.

While the invention has been illustrated and described in detail in the drawings and foregoing description, the same is to be considered as illustrative and not restrictive in character, it being understood that only the prefered embodiments have been shown and described and that all changes and modifications that come within the spirit of the invention are desired to be protected.

The invention claimed is:

1. A construction assembly comprising:

a base plate having brackets;

a first pair of parallel horizontal wood beams mounted to said base plate;

a second pair of parallel horizontal wood beams mounted to said base plate;

a first pair of boots mounted to opposite ends of said first pair of beams;

a first member having opposite ends mounted to said boots placing said member in tension and said first pair of beams in compression;

a second pair of boots mounted to opposite ends of said second pair of beams;

a second member having opposite ends mounted to said second pair of boots placing said second member in tension and said second pair of beams in compression;

first adjustment means connecting one of said first pair of boots with one of said brackets and being operable to horizontally position said first pair of beams relative to said base plate; and, second adjustment means connecting one of said second pair of boots with another of said brackets and being operable to horizontally position said second pair of beams relative to said base plate.

2. The assembly of claim 1 wherein said first adjustment means and said second adjustment means includes threaded members mounted to one of said first pair of boots and to one of said second pair of boots and to said brackets adjacent said boots being adjustable to control horizontal spacing between said boots and said brackets.

3. The assembly of claim 2 wherein:

said brackets and said base plate are co-planar therewith but are bendable to extend upwardly when connected to said boots by said first and second adjustment means.

4. The assembly of claim 3 wherein said first member is a cable positioned between said first pair of beams and said second member as a cable positioned between said second pair of beams.

5. The assembly of claim 4 wherein said base plate has four separate brackets thereon positioned at 90° intervals.

* * * * *